US007562486B2

(12) United States Patent
LoRocco

(10) Patent No.: US 7,562,486 B2
(45) Date of Patent: Jul. 21, 2009

(54) SELF-ILLUMINATED SIGHTING DEVICE

(75) Inventor: Paul LoRocco, Dallas, TX (US)

(73) Assignee: TruGlo, Inc., Richardson, TX (US)

( * ) Notice: Subject to any disclaimer, the term of this patent is extended or adjusted under 35 U.S.C. 154(b) by 136 days.

(21) Appl. No.: 11/776,675

(22) Filed: Jul. 12, 2007

(65) Prior Publication Data

US 2009/0013581 A1 Jan. 15, 2009

(51) Int. Cl.
*F41G 1/32* (2006.01)

(52) U.S. Cl. ..... 42/132; 42/145

(58) Field of Classification Search ..... 42/123, 42/131, 132, 144, 145
See application file for complete search history.

(56) References Cited

U.S. PATENT DOCUMENTS

| | | | | | |
|---|---|---|---|---|---|
| 2,706,335 | A | * | 4/1955 | Munsey | 42/145 |
| 3,678,590 | A | * | 7/1972 | Hayward | 42/132 |
| 3,700,339 | A | * | 10/1972 | Steck, III | 356/247 |
| 3,813,790 | A | * | 6/1974 | Kaltmann | 42/132 |
| 3,949,482 | A | * | 4/1976 | Ross | 42/120 |
| 3,991,500 | A | * | 11/1976 | Kershner et al. | 42/120 |
| 4,030,203 | A | * | 6/1977 | Ackerman, Jr. | 42/123 |
| 4,434,560 | A | * | 3/1984 | Comeyne | 42/132 |
| 5,359,800 | A | | 11/1994 | Fisher et al. | |
| RE35,347 | E | | 10/1996 | Bindon | |
| 5,862,618 | A | * | 1/1999 | Brown | 42/145 |
| 5,878,521 | A | * | 3/1999 | Warnock | 42/145 |
| 5,956,854 | A | | 9/1999 | Lorocco | |
| 6,014,830 | A | | 1/2000 | Brown et al. | |
| 6,016,608 | A | * | 1/2000 | Lorocco | 33/265 |
| 6,122,833 | A | | 9/2000 | Lorocco | |
| 6,216,351 | B1 | | 4/2001 | Flubacher et al. | |
| 6,216,352 | B1 | | 4/2001 | Lorocco | |
| 6,233,836 | B1 | | 5/2001 | Uhlmann et al. | |
| 6,385,855 | B1 | | 5/2002 | Tymianski | |
| 6,571,482 | B1 | | 6/2003 | Tymianski | |
| 6,571,504 | B2 | | 6/2003 | Carlson | |
| 6,640,482 | B2 | | 11/2003 | Carlson | |
| 6,817,105 | B2 | | 11/2004 | LoRocco | |
| 2007/0107292 | A1 | * | 5/2007 | Bar-Yona et al. | 42/144 |

FOREIGN PATENT DOCUMENTS

| | | |
|---|---|---|
| GB | 2320721 | 7/1998 |

* cited by examiner

*Primary Examiner*—Bret Hayes
(74) *Attorney, Agent, or Firm*—Alvin R. Wirthlin

(57) ABSTRACT

An illuminated sighting device includes a capsule with an integrally formed lens that is adapted to face rearwardly for viewing by a user. An elongate light collector is positioned within the hollow interior of the capsule and is formed such that light can be gathered along its length and transmitted to its ends. One of the light collector ends is located adjacent to the first lens and defines a sight point or dot. An artificial light source is located within the capsule hollow interior and is oriented for projecting radiant energy into the second light collector end so that the sight point is viewable during dark or low light conditions.

36 Claims, 6 Drawing Sheets

SELF-ILLUMINATED SIGHTING DEVICE

BACKGROUND OF THE INVENTION

This invention relates generally to sighting devices for firearms, archery bows, or other projectile launching devices, and more particularly to a self-illuminated sighting device having both a light collector, such as a fluorescent-doped fiber optic, and an artificial light source for illuminating the light collector in low light or dark conditions.

Sighting devices using short segments of light gathering fiber optics, such as scintillating or fluorescent-doped fiber optics, are currently in use. Such fiber optics gather ambient light along their length and transmit that light to their ends. Under ideal lighting conditions, one end of the fiber optic typically serves as a bright aiming point, the brightness being directly dependent on the level of ambient light incident on the length of fiber optic. However, the short segments of fiber optic have a limited light gathering ability. Under very low lighting conditions, such as at late dusk or early dawn, the sight point may not have sufficient brightness to satisfy some users. In order to augment the brightness of the sight point under these conditions, the addition of artificial light sources such as battery-operated LED's or tritium-type devices has been proposed.

However, installation of the individual components, such as the artificial light source and light gathering fiber optic, into the cavity of a gun sight or the like is time consuming and error prone since it is difficult to determine through the opaque sight blade whether the components are axially aligned, resulting in less than adequate illumination of the sight point. It would therefore be desirable to provide a self-illuminating sighting device that overcomes at least some of the disadvantages of the prior art.

BRIEF SUMMARY OF THE INVENTION

According to one aspect of the invention, an illuminated sighting device includes a capsule with a continuous side wall that defines a hollow interior and first and second capsule ends that enclose the hollow interior. The first capsule end has an integrally formed first lens that is adapted to face rearwardly for viewing by a user. An elongate light collector is positioned within the hollow interior and has an elongate light collecting body with first and second light collector ends. The light collector is formed such that light can be gathered along its length and transmitted to at least the first light collector end. The first light collector end is located adjacent to the first lens and defines a sight point or dot that is adapted to face rearwardly for viewing by a user through the first lens. An artificial light source is oriented for projecting radiant energy into the second light collector end so that the sight point is viewable during dark or low light conditions. In one embodiment of the invention, the artificial light source is located within the hollow interior of the capsule. In another embodiment of the invention, the artificial light source is located outside of the capsule.

According to a further aspect of the invention, an illuminated sighting device includes a capsule with a continuous side wall that defines a hollow interior and first and second capsule ends that enclose the hollow interior. The first capsule end is adapted to face rearwardly for viewing by a user. An elongate light collector is positioned within the hollow interior and has an elongate light collecting body with first and second light collector ends. The light collector is formed such that light can be gathered along its length and transmitted to at least the first light collector end. The first light collector end is located adjacent to the first capsule end and defines a sight point or dot that is adapted to face rearwardly for viewing by a user through the first capsule end. An artificial light source is oriented for projecting radiant energy into the second light collector end so that the sight point is viewable during dark or low light conditions. The continuous side wall and at least the first capsule end are transparent or translucent to radiant energy in at least a portion of the visible light spectrum such that radiant energy passing through the continuous side wall is incident on the light collector, and radiant energy from the light collector and artificial light source can be transmitted through the first capsule end for viewing by a user. In one embodiment of the invention, the artificial light source is located within the hollow interior of the capsule. In another embodiment of the invention, the artificial light source is located outside of the capsule.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

It is noted that the drawings are intended to depict typical embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Figure 1:
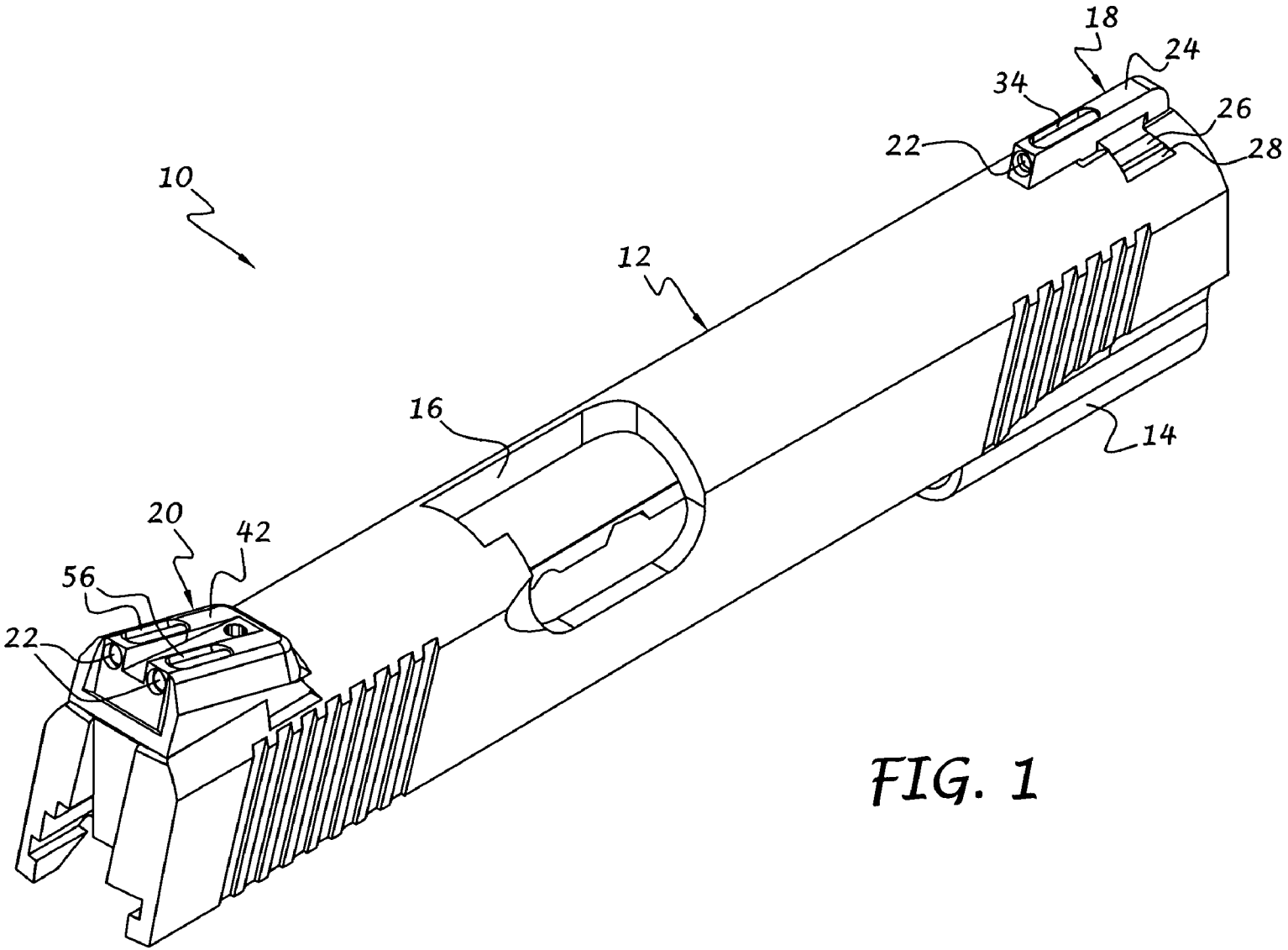
FIG. 1 is a rear isometric view of a sight assembly in accordance with an exemplary embodiment of the present invention for mounting to a handgun.
Figure 2:
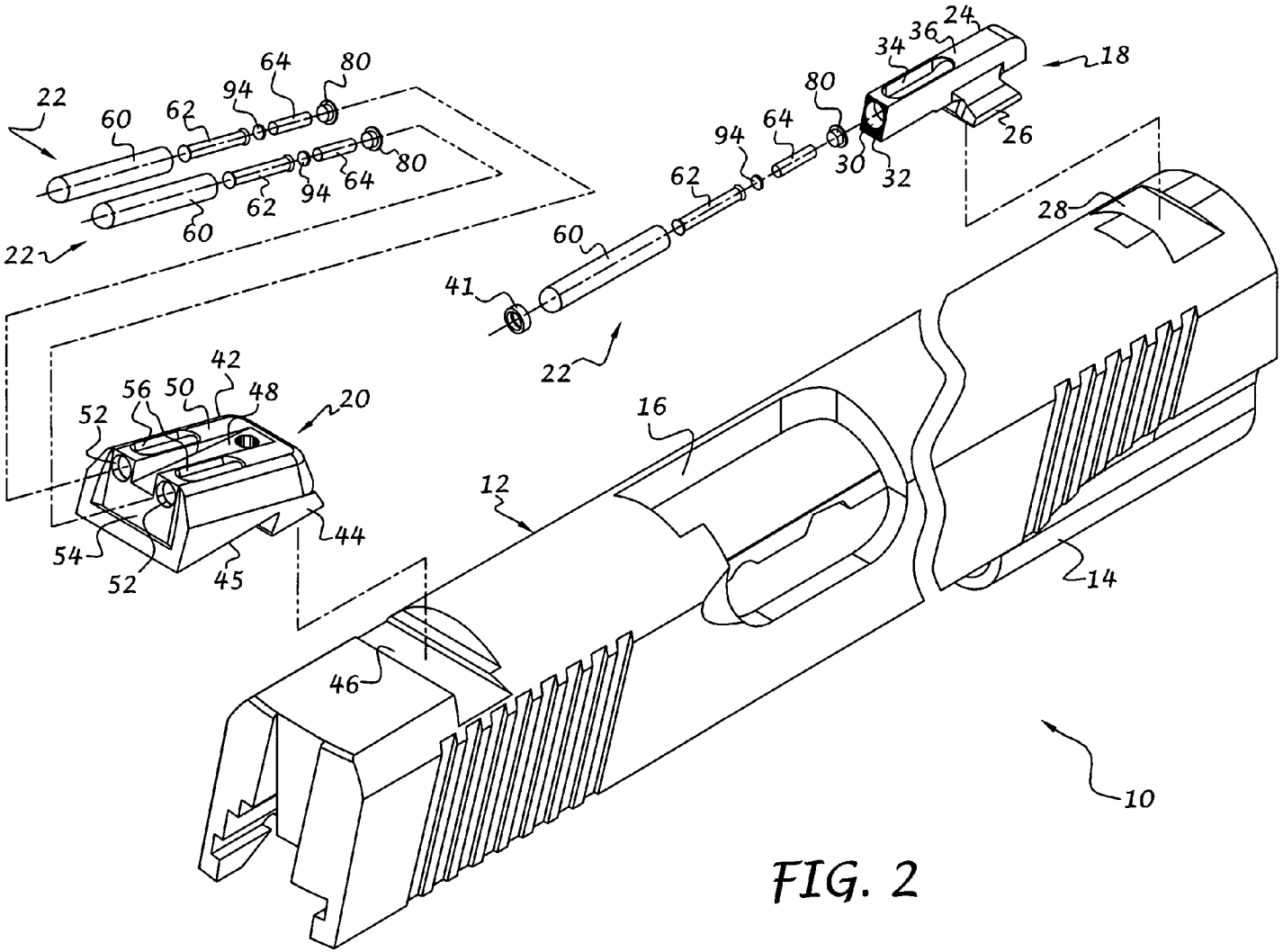
FIG. 2 is a rear isometric exploded view of the sight assembly of FIG. 1.

Referring to the drawings, and to FIGS. 1 and 2 in particular, a sight assembly 10 in accordance with the present invention is illustrated. The sight assembly 10 can be adapted for use with a particular projectile launching device (not shown) such as a handgun, rifle, pellet gun, BB gun, bow, or the like. As illustrated, and by way of example only, the sight assembly 10 may include a mounting base 12 that is slidably mounted to a handgun (not shown), with a barrel-receiving tube 14, an opening 16 for accommodating cartridges ejected from the handgun, a front sight module 18 and a rear sight module 20 positioned at forward and rearward ends, respectively, of the mounting base 12. Each sight module preferably includes one or more illuminated sighting devices 22 that serve as sight points or dots for aligning the projectile launching device with a distal target.

Figure 3:
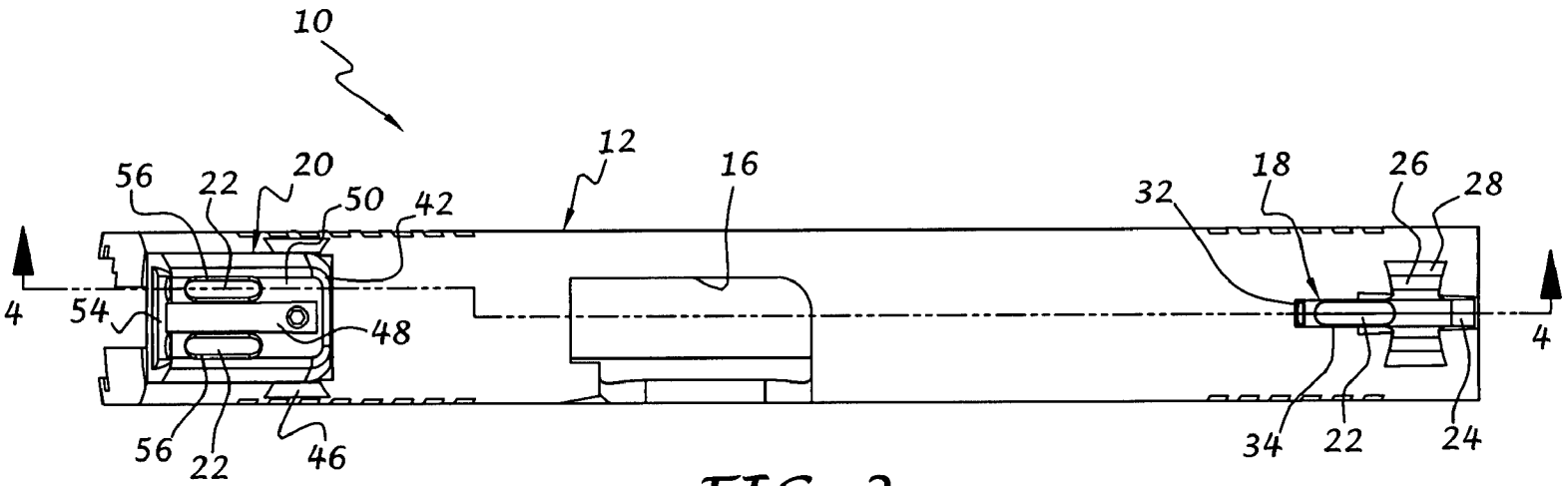
FIG. 3 is a top plan view of the sight assembly.
Figure 4:
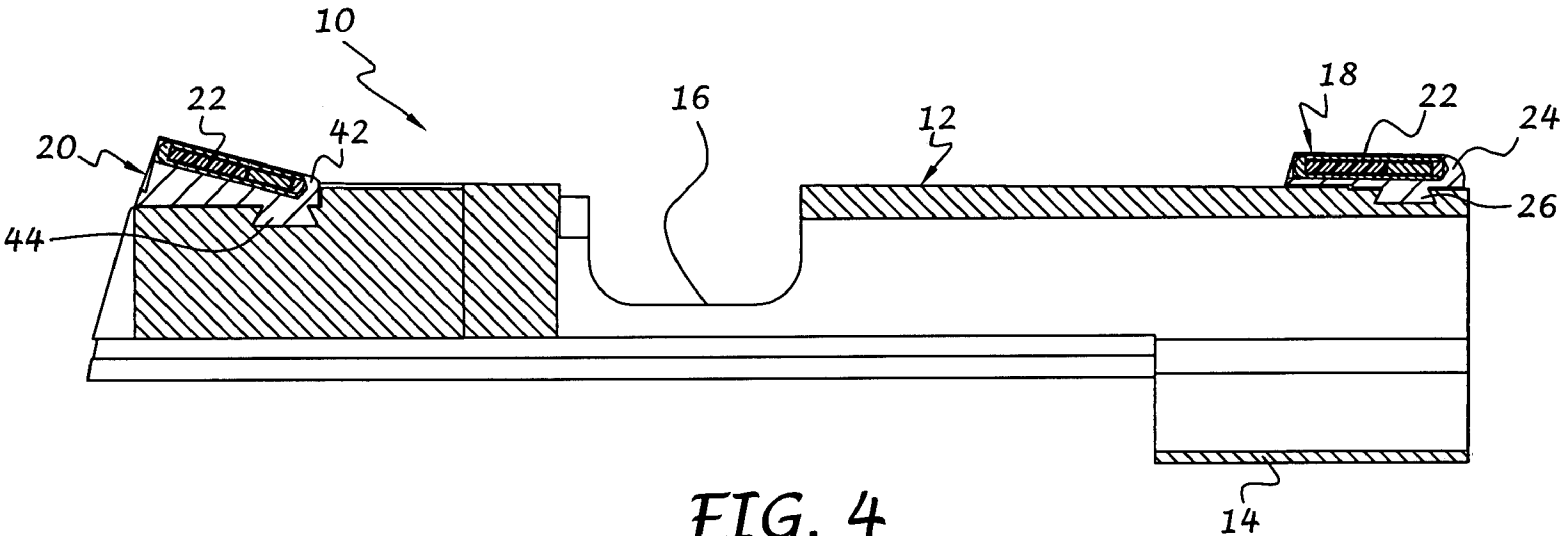
FIG. 4 is a sectional view of the sight assembly taken along line 4-4 of FIG. 3.
Figures 5, 6:
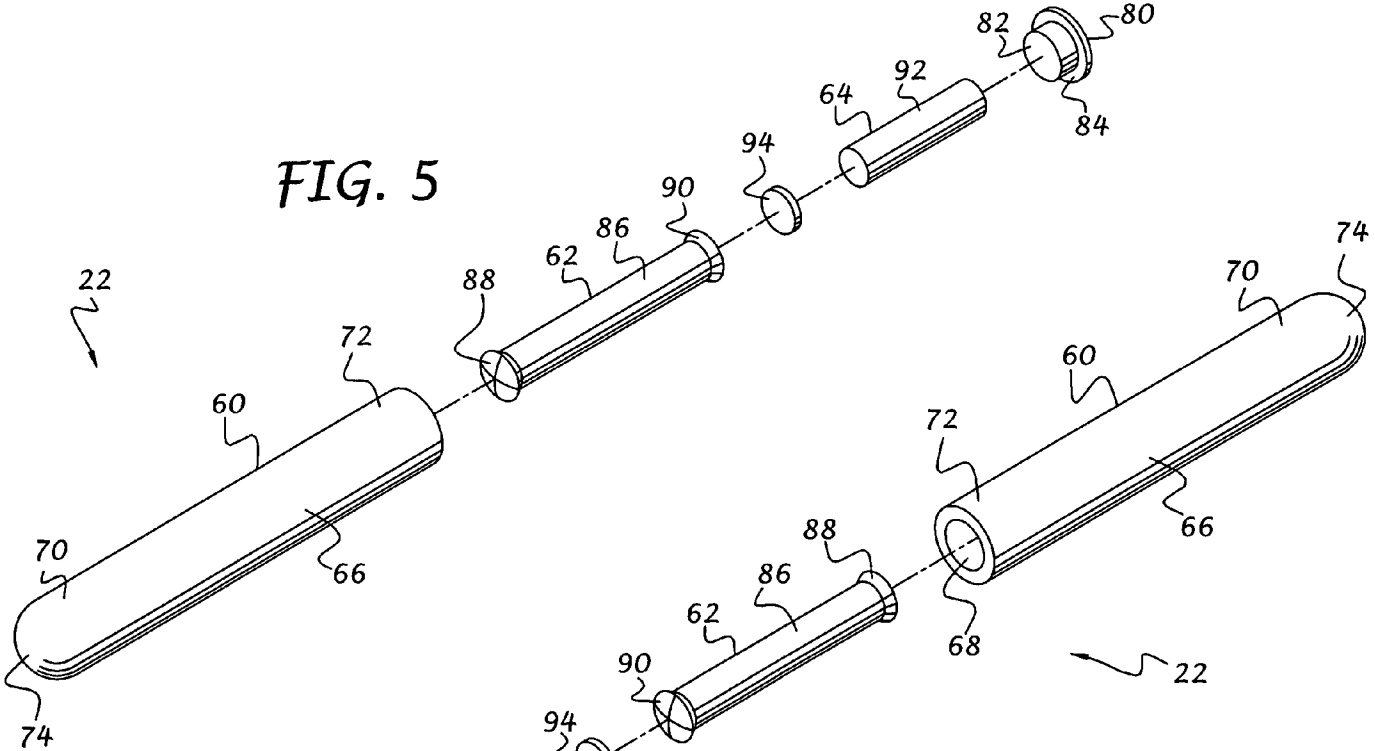
FIG. 5 is a rear isometric exploded view of an illuminated sighting device that forms part of the sight assembly of FIG. 1.
FIG. 6 is a front isometric perspective view of the illuminated sighting device.
Figure 7:
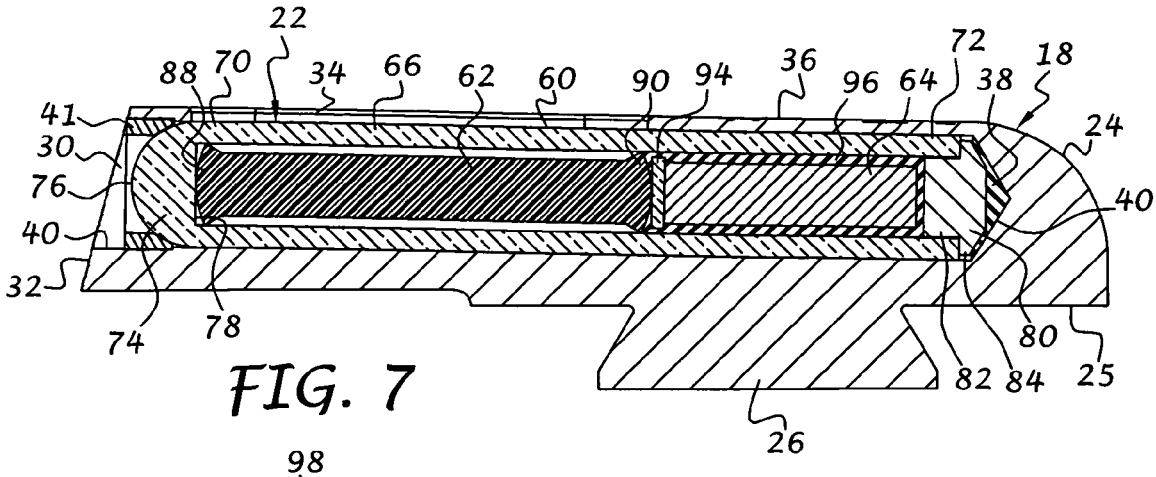
FIG. 7 is an enlarged sectional view of the front sight module of FIG. 4.

With additional reference to FIGS. 3, 4 and 7, the front sight module 18 preferably includes a front base member 24 with a dovetail-shaped projection 26 that extends downwardly from a lower surface 25. The projection 26 is received in a complementary front dovetail-shaped groove 28 of the mounting base 12 in a well-known manner. A cavity 30 extends into the base member 24 from a front surface 32 and is sized for receiving the illuminated sighting device 22. A window 34 extends into the cavity 30 from an upper surface 36 so that electromagnetic radiation, preferably in the visible light spectrum, is incident on a portion of the sighting device 22. In order to reduce shock on the sighting device 22 that may occur during use of a firearm or when dropped or otherwise impacted, an impact-absorbing material 38 (FIG. 7), such as room temperature vulcanization (RTV) silicon or other elastomer, may be located in the cavity 30 between the sighting device 22 and inner cavity surface 40. Although not shown, the impact-absorbing material 38 may partially or completely surround the sighting device 22 with the exception of the portions exposed through the window 34 and cavity 30. However, where the material 38 is sufficiently translucent or transparent to at least a portion of the visible light spectrum, the sighting device may be completely surrounded by the material. A mounting ring 41 may be pressed into or otherwise installed in the cavity 30 after the sighting device 22 is inserted.

As shown in FIGS. 2-4 and 7, the rear sight module 20 preferably includes a rear base member 42 with a dovetail-shaped projection 44 that extends downwardly from a lower surface 45. The projection 44 is received in a complementary rear dovetail-shaped groove 46 of the mounting base 12 in a well-known manner. A slot 48 is formed in an upper surface 50 of the base member 42 and a cavity 52 extends into the base member 42 from a front surface 54 on either side of the slot 48. As in the front site module 18, each cavity 52 of the rear sight module 20 is sized for receiving an illuminated sighting device 22. A window 56 extends into each cavity 52 from the upper surface 50 so that electromagnetic radiation, preferably in the visible light spectrum, is incident on a portion of the sighting device 22. In order to reduce shock on the sighting device 22, an impact-absorbing material (not shown), such as RTV silicon or other elastomer, may be located in each cavity 52 as previously described with respect to the front sight module 18.

It will be understood that the terms "mounting base" and "base member" as used herein may include any arrangement or structure for connecting one or more sighting devices 22 to a projectile launching device or to any other structure where a self-illuminating sighting device or marker can be used. Accordingly, the illuminated sighting device 22 of the present invention is readily adaptable for use with telescopes, sighting scopes, and so on, in order to quickly align the scope with a distal target or scene, as well as other devices used in sighting, marking, or aligning applications.

Referring now to FIGS. 2 and 5-7, each illuminated sighting device 22 preferably includes an enclosed capsule 60 with an elongate light collector 62 and an artificial light source 64 located within the capsule forwardly of the light collector and preferably coaxial therewith.

The capsule 60 has a continuous side wall 66 that defines a hollow interior 68 (FIG. 6) with a first capsule end 70 and a second capsule end 72. The first capsule end preferably includes a first lens 74 that is integrally formed with the continuous side wall 68 during the manufacturing process. However, it will be understood that the lens 74 may be formed separately and connected to the side wall 68 through any well known connection means, such as adhesive bonding, heat sealing, fusing, press-fitting, clamping or fastening, and so on. The first lens 74 is adapted to face rearwardly for viewing by a user. As best shown in FIG. 7, the lens 74 is preferably a convex planar lens with an outer convex surface 76 and inner planar surface 78. However, it will be understood that the lens 74 may be of any shape or configuration.

The second capsule end 72 preferably includes an end cap or plug 80 that is sealed to the continuous side wall 66 with a reduced section 82 that fits within the hollow interior 68 and an enlarged section 84 that abuts the continuous side wall 66. The end cap 80 is preferably affixed to the side wall 66 through adhesive bonding to thereby form a labyrinth seal. In this manner, the first and second capsule ends enclose the hollow interior 68 so that the internal components are sealed from the outside environment. It will be understood that the end cap 80 may be connected to the side wall 66 through other well known connection means, such as heat sealing, fusing, press-fitting, clamping or fastening, and so on.

The continuous side wall and integral lens are preferably constructed of a material that is transparent or translucent to radiant energy in at least a portion of the visible light spectrum such that radiant energy passing through the continuous side wall is incident on the light collector, and radiant energy incident on the light collector and artificial light source can be transmitted through the lens 74 for viewing by a user. To that end, suitable materials may include clear or tinted Pyrex® or other borosilicate glass, plastic, a mixture of glass and plastic, Teflon® or other fluorinated polymer, and so on. Although not shown, the continuous side wall 66 and/or lens 74 may have a coated surface to match the wavelength of radiant energy emitted by the light collector 62 and/or to enhance the brightness of the light collector. The inner and/or outer surface of the side wall 66 may also or alternatively be roughened to enhance the transfer of light to the light collector and/or to provide a particular visual effect. Although the capsule 60 is preferably circular in cross section, it is contemplated that other cross sectional shapes such as oval, triangular, rectangular, arcuate, etc., may be used. Moreover, it will be understood that the capsule 60 is not limited to the particular materials as set forth in the exemplary embodiment.

The elongate light collector 62 is positioned within the hollow interior 68 and has an elongate light collecting body 86 with a second lens 88 formed at one end of the body 86 and a third lens 90 formed at an opposite end thereof. The second lens 88 is located adjacent to the first lens 74 and defines an illuminated sight point or dot that faces rearwardly for viewing by a user through the first lens. It will be understood that the term "adjacent" as used throughout the specification can mean abutting, juxtaposed, touching or near (without actually touching). The third lens 90 faces forwardly to receive light from the artificial light source 64. The second and third lenses 88, 90 are preferably of convex shape and can be formed by heating the ends of the light collecting body at a predetermined temperature and for a predetermined time which causes expansion of the light collector material. The particular temperature and exposure time can vary depending on the type of material as well as the diameter or thickness of the light collecting body 86. It will be understood that one or both of the lenses 88, 90 may be eliminated without departing from the spirit and scope of the present invention.

The light collector 62 is preferably constructed of a fluorescent-doped fiber optic or the like. A suitable fluorescent-doped fiber optic may be constructed of a polystyrene-based core containing one or more fluorescent dopants that is surrounded by a polystyrene, polymethyl methacrylate, or fluoropolymer cladding. When such a fiber optic receives radiation along its length, energy is absorbed in the fiber optic at a certain wavelength and is re-emitted at both ends of the fiber optic at a longer wavelength. Thus, depending on the amount of radiation absorbed by the fiber optic along its length, a proportionate amount of radiation is emitted at the ends of the fiber optic. Although the light collector 62 is preferably circular in cross section, it is contemplated that other cross sectional shapes such as oval, triangular, rectangular, arcuate, etc., may be used. Moreover, it will be understood that the light collector 62 is not limited to the particular material as set forth in the exemplary embodiment. The core and cladding may be formed out of any suitable transparent or translucent material. The cladding material itself may be air or other fluid surrounding at least a portion of the core, and so on. Accordingly, it will be understood that the light collector may be in the form of a molded piece of plastic with or without a fluorescent dopant. It will be further understood that the length, diameter or thickness and the amount of dopant within the core of the light collector 62 can vary and depends on the desired brightness of the sight point as viewed by the user under varying ambient conditions.

The artificial light source 64 is located within the hollow interior 68 of the capsule 60 and is oriented for projecting radiant energy into the third lens 90 of the light collector 62, through the elongate light collecting body 86 and out of the second lens 88 so that the sight point is viewable during dark or low light conditions where the light collector by itself would not produce sufficient illumination. Although many different types of artificial light sources may be used, such as a battery-powered LED's, luminescent paint, chemiluminescent devices, electroluminescent wires, and so on, a radioluminescent light source, such as a tritium vial 92, is preferable. Such a vial is typically constructed of a borosilicate tube that has been coated on its inner surface with a phosphor compound. Tritium gas is located within the tube and interacts with the phosphor coating to produce light in the visible spectrum. Various preparations of the phosphorus compound can be used to produce different colors of light, such as green, yellow, blue, red, purple, and orange. Preferably, the particular wavelength or color of light exiting the tritium vial 92 is similar to the color of dopant material used in the light collector 62.

Due to the relatively fragile nature of the tritium vial 92 and the great amount of impact that may be exerted on the vial during use, a fourth lens 94 can be located between the third lens 90 and the vial 92. The fourth lens 94 preferably comprises a transparent or translucent adhesive layer, such as silicon or other transparent or translucent impact-absorbing adhesive material. In addition, impact-absorbing material 96 (FIG. 7), such as RTV silicon or other elastomer, is preferably located between the tritium vial 92, the continuous side wall 66 of the capsule 60, and the reduced section 82 of the end cap 80.

During assembly of the illuminated sighting device 22, the light collector 62 is first inserted into the hollow interior 68 of the capsule 60, followed by the fourth lens 94 and the tritium vial 92. Since the capsule 60 is constructed of a transparent or translucent material, axial alignment of the light collector 62 with the capsule 60 is facilitated. However, even if precise axial alignment is not obtained, the third lens 90 of the light collector 62 ensures that the light from the vial 92 is directed into the light collector. Likewise, the arrangement of the first lens 74 adjacent to the second lens 88 ensures that the entire convex surface 76 is illuminated. The capsule 62 may then be evacuated and filled with an inert gas, such as nitrogen, to prevent moisture build-up under different environmental conditions. The impact-absorbing material can then be inserted into the capsule 60 so that at least a portion of the material flows between the side wall 66 and the vial 92. The end cap 80 is then installed on the vial as previously described.

To illustrate the compact nature of the illuminated sighting device 22, and by way of example only, the length of the capsule 60 in accordance with one exemplary embodiment of the invention is approximately 0.800 inch, an outside diameter of the capsule is approximately 0.120 inch while an inner diameter of the capsule is approximately 0.078 inch. The diameter of the light collecting body 86 is approximately 0.060 inch while the diameter of the second and third lenses is approximately 0.075 inch. It will be understood that the particular dimensions, as well as the ratios between length and diameter, may greatly vary without departing from the spirit and scope of the present invention. The compact, modular nature of the illuminated sighting device 22 facilitates its installation into various sighting or aligning devices to thereby reduce assembly cost and increase productivity over prior art solutions, while preserving the integrity of its internal components and enhancing light output.

As best shown in FIG. 7, when the illuminated sighting device 22 is installed in one of the cavities 30, 52 of the front and rear sight modules, the light collector 62 is in alignment with the window 34 or 56 of the front or rear sight module, respectively. To that end, the windows 34 and 36 are preferably shaped to maximize exposure of the light collector to ambient light.

In use, light incident on the light collecting body 86 through the window 34 or 56 of the front or rear sight modules, respectively, is absorbed in the fiber optic and is re-emitted at the second lens 88 and at the third lens 90. The light incident on the second lens is viewable by a user through the first lens 74 of the capsule 60 to thereby serve as an illuminated sight point or dot for alignment with a desired distal target.

Figure 8:
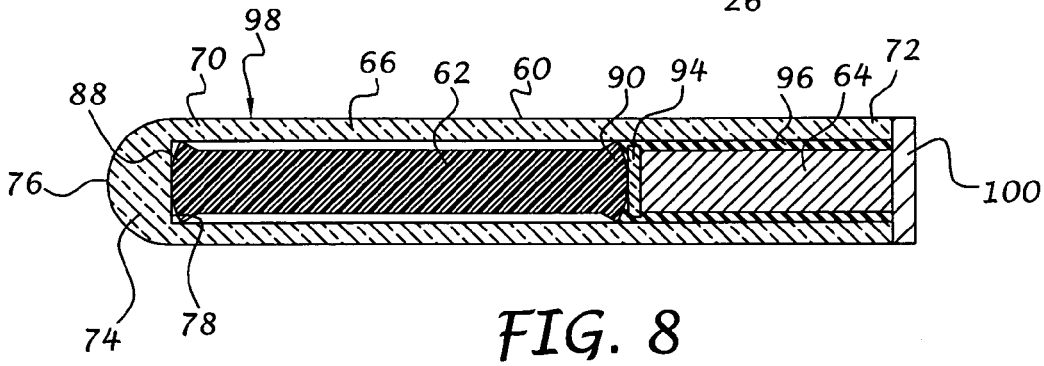
FIG. 8 is an enlarged sectional view of an illuminated sighting device in accordance with another embodiment of the invention.

Referring now to FIG. 8, an illuminated sighting device 98 in accordance with a further embodiment of the invention is illustrated. The sighting device 98 is similar in construction to the sighting device 22 previously described, with the exception that the end cap 80 of the previous embodiment is replaced with a flat disk 100. The disk 100 is preferably connected to the second capsule end 72 through adhesive bonding, but may alternatively be connected through heat sealing, fusion, mechanical fastening or other connection means. This embodiment advantageously reduces the amount of material needed for sealing the second capsule end 72 and thus helps to reduce both the weight and material cost of the sighting device 98 over the previous embodiment.

Figure 9:
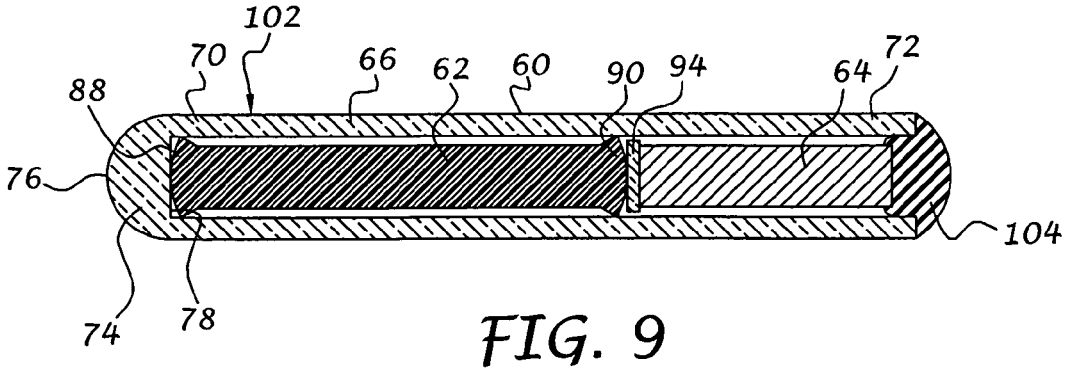
FIG. 9 is an enlarged sectional view of an illuminated sighting device in accordance with a further embodiment of the invention.

Referring now to FIG. 9, an illuminated sighting device 102 in accordance with a further embodiment of the invention is illustrated. The sighting device 102 is similar in construction to the sighting device 22 previously described, with the exception that the end cap 80 of the previous embodiment is replaced with impact-absorbing potting material 104, which also preferably surrounds at least a portion of the artificial light source 64. This embodiment advantageously reduces the number of parts and assembly steps over the previous embodiments.

Figure 10:
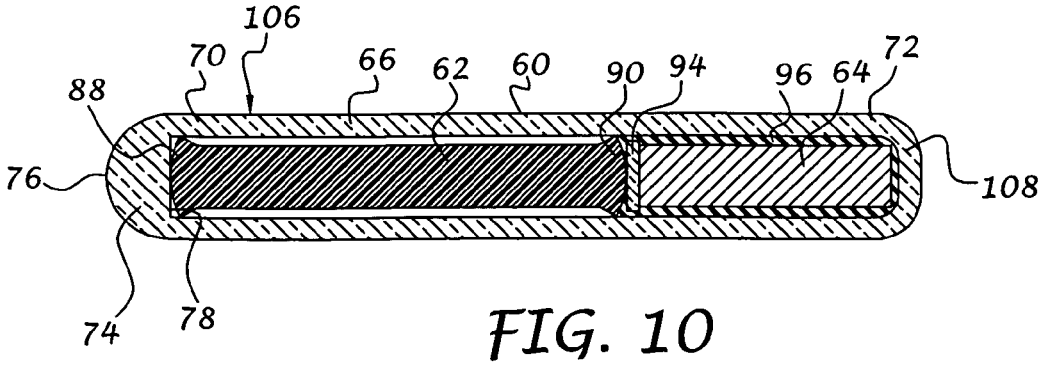
FIG. 10 is an enlarged sectional view of an illuminated sighting device in accordance with yet a further embodiment of the invention.

Referring now to FIG. 10, an illuminated sighting device 106 in accordance with a further embodiment of the invention is illustrated. The sighting device 106 is similar in construction to the sighting device 22 previously described, with the exception that the end cap 80 of the previous embodiment is eliminated and the second capsule end 72 is fused together to form an integral end wall 108 that, together with the integral first lens 74, completely seal the light collector 62, fourth lens 94, artificial light source 64, and the surrounding impact-absorbing material 96 within the capsule 60. When the capsule 60 is constructed of borosilicate glass, the second capsule end 72 may be fused together with a $CO_2$ laser, torch or other heat source, In order to prevent heat damage to the internal components during fusing, a water bath or other heat sink may be used.

Figure 11:
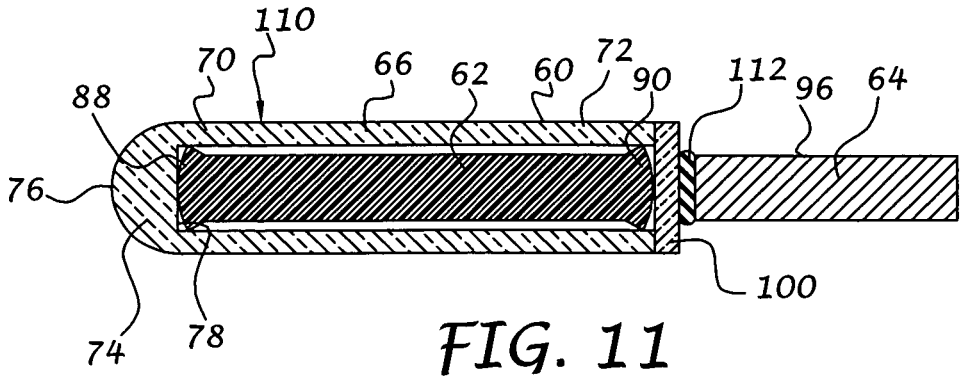
FIG. 11 is an enlarged sectional view of an illuminated sighting device in accordance with another embodiment of the invention.

Referring now to FIG. 11, an illuminated sighting device 110 in accordance with a further embodiment of the invention is illustrated. The sighting device 110 is similar in construction to the sighting device 98 previously described, with the exception that the light source 64 is located outside of the capsule 60 and is preferably connected to the flat disk 100 through a transparent or translucent adhesive layer 112, such as silicon or other transparent or translucent impact-absorbing adhesive material. This embodiment ensures that the light collector 62 will remain sealed against degradation and breakage that may otherwise occur if exposed to the outside environment. This embodiment is especially advantageous when the artificial light source 64 is either robust in nature or prepackaged to ensure robustness.

Figure 12:
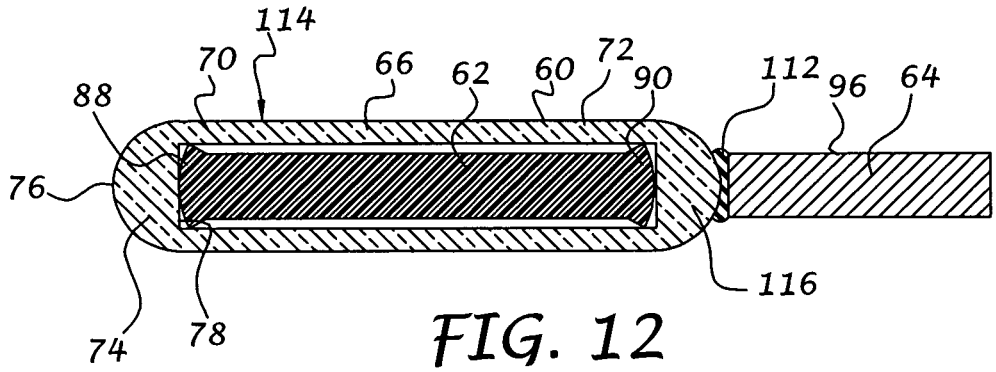
FIG. 12 is an enlarged sectional view of an illuminated sighting device in accordance with a further embodiment of the invention.

Referring now to FIG. 12, an illuminated sighting device 114 in accordance with another embodiment of the invention is illustrated. The sighting device 114 is similar in construction to the sighting device 110 previously described, with the exception that the flat disk 100 is preferably replaced with an integral lens 116 that is similar in shape to the lens 76 previously described. With this arrangement, light can be gathered from the artificial light source 64 more efficiently than the FIG. 11 embodiment.

Figure 13:
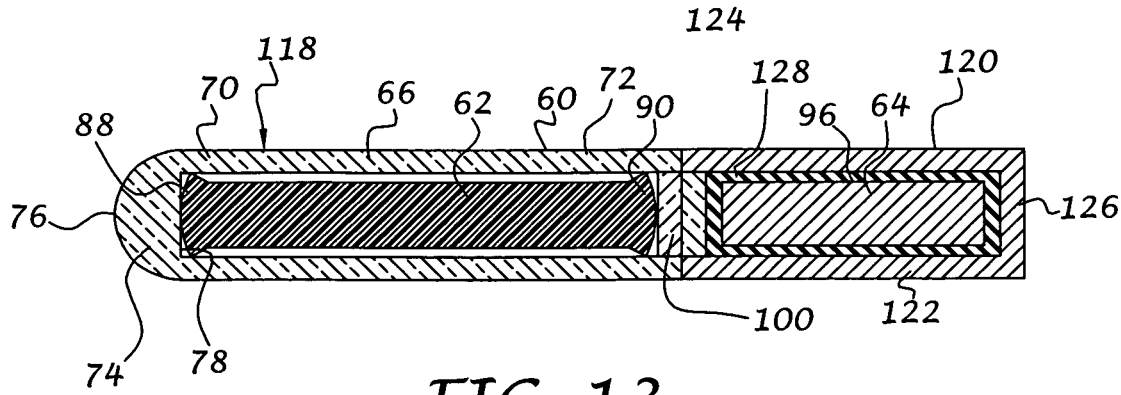
FIG. 13 is an enlarged sectional view of an illuminated sighting device in accordance with yet a further embodiment of the invention.

With reference now to FIG. 13, an illuminated sighting device 118 in accordance with yet a further embodiment of the invention is illustrated. The sighting device 118 is similar in construction to the sighting device 110 previously described, with the exception that the artificial light source 64 is positioned in a separate capsule 120. The capsule 120 preferably includes a continuous side wall 122 integrally formed with a rear wall 126 to define a hollow interior within which the artificial light source 64 is located. A front transparent or translucent wall or lens 124 closes the capsule and faces the flat disk 100 of the capsule 60. The artificial light source 64 is preferably surrounded by a transparent or translucent impact-absorbing material 128 so that radiant energy can be transmitted through the material 128, the lens 124, the disk 100, and into the light collector 62.

It will be understood that the term "preferably" as used throughout the specification refers to one or more exemplary embodiments of the invention and therefore is not to be interpreted in any limiting sense. It will be further understood that the term "lens" as used throughout the specification may refer to any object through which radiant energy may pass independent of material, shape and surface finish. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. By way of example, the capsule 60 may be cast with a transparent material around the light collector 62 and artificial light source 64 to form a compact, self-illuminating unit. It will be understood, therefore, that the present invention is not limited to the particular embodiments disclosed, but also covers modifications within the spirit and scope of the invention as defined by the appended claims.

What is claimed is:

1. An illuminated sighting device comprising:

a capsule having a continuous side wall that defines a hollow interior and first and second capsule ends that enclose the hollow interior, the first capsule end having an integrally formed first lens that is adapted to face rearwardly for viewing by a user;

an elongate light collector positioned within the hollow interior and having an elongate light collecting body with first and second light collector ends, the light collector being formed such that light can be gathered along a length of the light collector body and transmitted to at least the first light collector end, the first light collector end being located adjacent to the first lens and defining a sight point that is adapted to face rearwardly for viewing by a user through the first lens; and an artificial light source oriented for projecting radiant energy into the second light collector end and through the elongate light collector so that the sight point is viewable during dark or low light conditions;

the continuous side wall and integral lens being transparent or translucent to radiant energy in at least a portion of the visible light spectrum such that radiant energy passing through the continuous side wall is incident on the light collector, and radiant energy from the light collector and artificial light source can be transmitted through the lens for viewing by a user.

2. An illuminated sighting device according to claim 1, wherein the second capsule end comprises an end cap that is sealed to the continuous side wall.

3. An illuminated sighting device according to claim 2, wherein the end cap comprises a reduced section that fits within the hollow interior and an enlarged section that abuts the continuous side wall to thereby form a labyrinth seal.

4. An illuminated sighting device according to claim 1, wherein the second capsule end comprises a potting material to thereby enclose the hollow interior.

5. An illuminated sighting device according to claim 4, wherein the potting material surrounds at least a portion of the artificial light source within the hollow interior.

6. A sighting module comprising the illuminated sighting device of claim 1, and further comprising at least one base member for connection to a projectile launching device, the base member having at least one cavity for receiving the capsule.

7. A sighting module according to claim 6, wherein the base member includes at least one window that intersects with the cavity for exposing the light collector to radiant energy through the continuous side wall.

8. A sighting module according to claim 7, and further comprising an impact-absorbing material located between the capsule and the base member.

9. An illuminated sighting device according to claim 1, wherein the elongate light collector comprises a fluorescent-doped fiber optic material.

10. An illuminated sighting device according to claim 1, wherein the artificial light source is located within the hollow interior.

11. An illuminated sighting device comprising:

a capsule having a continuous side wall that defines a hollow interior and first and second capsule ends that enclose the hollow interior, the first capsule end having an integrally formed first lens that is adapted to face rearwardly for viewing by a user, the first lens comprising a convex lens;

an elongate light collector positioned within the hollow interior and having an elongate light collecting body with first and second light collector ends, the light collector being formed such that light can be gathered along a length thereof and transmitted to at least the first light collector end, the first light collector end being located adjacent to the first lens and defining a sight point that is adapted to face rearwardly for viewing by a user through the first lens; and an artificial light source oriented for projecting radiant energy into the second light collector end and through the elongate light collector so that the sight point is viewable during dark or low light conditions.

12. An illuminated sighting device according to claim 11, wherein the first light collector end comprises an integrally formed second convex lens.

13. An illuminated sighting device according to claim 12, wherein the second light collector end comprises an integrally formed third convex lens.

14. An illuminated sighting device according to claim 13, wherein the artificial light source comprises a tritium vial.

15. An illuminated sighting device according to claim 14, and further comprising a fourth lens positioned between the second light collector end and the tritium vial.

16. An illuminated sighting device according to claim 15, and further comprising an impact-absorbing material located between the tritium vial and the continuous side wall.

17. An illuminated sighting device according to claim 16, wherein the impact-absorbing material comprises an elastomeric material.

18. An illuminated sighting device according to claim 17, wherein the second capsule end comprises an end cap that is sealed to the continuous side wall.

19. An illuminated sighting device according to claim 11, wherein the convex lens is a convex planar lens.

20. An illuminated sighting device comprising:

a capsule having a continuous side wall that defines a hollow interior and first and second capsule ends that enclose the hollow interior, the first capsule end being adapted to face rearwardly for viewing by a user;

an elongate light collector positioned within the hollow interior and having an elongate light collecting body with first and second light collector ends, the light collector being formed such that light can be gathered along a length of the light collector body and transmitted to at least the first light collector end, the first light collector end being located adjacent to the first capsule end and defining a sight point that is adapted to face rearwardly for viewing by a user through the first capsule end; and an artificial light source oriented for projecting radiant energy into the second light collector end and through the elongate light collector so that the sight point is viewable during dark or low light conditions;

the continuous side wall and at least the first capsule end being transparent or translucent to radiant energy in at least a portion of the visible light spectrum such that radiant energy passing through the continuous side wall is incident on the light collector, and radiant energy from the light collector and artificial light source can be transmitted through the first capsule end for viewing by a user.

21. An illuminated sighting device according to claim 20, wherein the first capsule end comprises a first lens.

22. An illuminated sighting device according to claim 21, wherein the first lens comprises a convex lens.

23. An illuminated sighting device according to claim 21, wherein the convex lens is a convex planar lens.

24. An illuminated sighting device according to claim 23, wherein the first light collector end comprises an integrally formed second convex lens.

25. An illuminated sighting device according to claim 24, wherein the second light collector end comprises an integrally formed third convex lens.

26. An illuminated sighting device according to claim 25, wherein the artificial light source comprises a tritium vial.

27. An illuminated sighting device according to claim 26, and further comprising a fourth lens positioned between the second light collector end and the tritium vial.

28. An illuminated sighting device according to claim 27, and further comprising an impact-absorbing material located between the tritium vial and the continuous side wall.

29. An illuminated sighting device according to claim 28, wherein the impact-absorbing material comprises an elastomeric material.

30. An illuminated sighting device according to claim 29, wherein the second capsule end comprises an end cap that is sealed to the continuous side wall.

31. An illuminated sighting device according to claim 25, wherein the elongate light collector comprises a fluorescent-doped fiber optic material.

32. An illuminated sighting device according to claim 21, wherein the first lens is integrally formed with the continuous side wall.

33. An illuminated sighting device according to claim 20, wherein the second capsule end comprises an end cap that is sealed to the continuous side wall.

34. An illuminated sighting device according to claim 20, wherein the elongate light collector comprises a fluorescent-doped fiber optic material.

35. An illuminated sighting device according to claim 20, wherein the artificial light source is located within the hollow interior.

36. An illuminated sighting device according to claim 20, wherein the artificial light source comprises tritium.

* * * * *

UNITED STATES PATENT AND TRADEMARK OFFICE

CERTIFICATE OF CORRECTION

PATENT NO. : 7,562,486 B2
APPLICATION NO. : 11/776675
DATED : July 21, 2009
INVENTOR(S) : Paul LoRocco et al.

It is certified that error appears in the above-identified patent and that said Letters Patent is hereby corrected as shown below:

Title Page: Item 75 should read

Inventors: Paul LoRocco
John Estridge

Signed and Sealed this
Seventeenth Day of March, 2015

Michelle K. Lee

Michelle K. Lee
*Director of the United States Patent and Trademark Office*